US009093044B2

(12) United States Patent
Cho et al.

(10) Patent No.: US 9,093,044 B2
(45) Date of Patent: Jul. 28, 2015

(54) DISPLAY PANEL AND DISPLAY APPARATUS HAVING THE SAME

(71) Applicant: Samsung Display Co., Ltd., Yongin (KR)

(72) Inventors: Se-Hyoung Cho, Hwaseong-si (KR); Il-Gon Kim, Seoul (KR); Mee-Hye Jung, Suwon-si (KR); In-Jae Hwang, Suwon-si (KR)

(73) Assignee: Samsung Display Co., Ltd., Yongin (KR)

( * ) Notice: Subject to any disclaimer, the term of this patent is extended or adjusted under 35 U.S.C. 154(b) by 37 days.

(21) Appl. No.: 14/016,955

(22) Filed: Sep. 3, 2013

(65) Prior Publication Data

US 2014/0333592 A1 Nov. 13, 2014

(30) Foreign Application Priority Data

May 13, 2013 (KR) ..... 10-2013-0053900

(51) Int. Cl.
*G09G 3/36* (2006.01)

(52) U.S. Cl.
CPC ..... *G09G 3/3677* (2013.01); *G09G 2310/06* (2013.01); *G09G 2320/0223* (2013.01); *G09G 2320/0252* (2013.01)

(58) Field of Classification Search
CPC ..... G09G 3/3659; G09G 3/3674; G09G 2310/0205; G09G 2310/0208; G09G 2310/021
USPC ..... 345/94, 98, 99, 100
See application file for complete search history.

(56) References Cited

U.S. PATENT DOCUMENTS

| | | | | |
|---|---|---|---|---|
| 5,568,163 | A * | 10/1996 | Okumura | 345/100 |
| 6,933,917 | B2 | 8/2005 | Chung et al. | |
| 2008/0001882 | A1 | 1/2008 | Lee | |
| 2008/0266477 | A1 * | 10/2008 | Lee et al. | 345/94 |
| 2009/0046085 | A1 | 2/2009 | Ino et al. | |
| 2011/0018846 | A1 | 1/2011 | Hu et al. | |
| 2014/0078123 | A1 * | 3/2014 | Park et al. | 345/205 |
| 2014/0092082 | A1 * | 4/2014 | Choi | 345/99 |

FOREIGN PATENT DOCUMENTS

| | | |
|---|---|---|
| KR | 10-1999-0052421 | 7/1999 |
| KR | 10-2000-0027750 | 5/2000 |
| KR | 10-2003-0054882 | 7/2003 |
| KR | 10-2005-0111966 | 11/2005 |
| KR | 10-2006-0029063 | 4/2006 |
| KR | 10-2007-0077582 | 7/2007 |
| KR | 10-2008-0035369 | 4/2008 |
| KR | 10-2008-0076519 | 8/2008 |

* cited by examiner

*Primary Examiner* — Kevin Nguyen
(74) *Attorney, Agent, or Firm* — H.C. Park & Associates, PLC

(57) ABSTRACT

A display apparatus includes a display panel, a gate driving part, and a date driving part. The display panel includes a switching element disposed in association with a pixel, a main gate line connected to the switching element, and a sub gate line spaced apart from the main gate line and connected to the main gate line via a first connecting part. The gate driving part is configured to: provide the main gate line with a main gate signal, and provide the sub gate line with a sub gate signal. The sub gate signal includes a transmission difference from the main gate signal. The data driving part is configured to provide a data line with a data signal.

20 Claims, 8 Drawing Sheets

DISPLAY PANEL AND DISPLAY APPARATUS HAVING THE SAME

CROSS-REFERENCE TO RELATED APPLICATION

This application claims priority from and the benefit of Korean Patent Application No. 10-2013-0053900, filed on May 13, 2013, which is incorporated by reference for all purposes as if fully set forth herein.

BACKGROUND

1. Field

Exemplary embodiments relate to display technology. More particularly, exemplary embodiments relate to a display panel configured to improve display quality and a display apparatus including the display panel.

2. Discussion

Generally, a liquid crystal display (LCD) device (or apparatus) is relatively thin and light weight. An LCD apparatus will typically also consume a relatively low amount of power. As such, LCD devices are used in an assortment of consumer electronic devices, such as monitors, laptop computers, mobile phones, tablets, etc., as well as find implementation in various other devices, such as appliances, signs, vehicles, etc. Conventional LCD devices typically include: an LCD panel to display images based on controlled light transmittance of liquid crystal; a backlight assembly disposed under the LCD panel to provide light to the LCD panel; and one or more driving circuits to drive the LCD panel.

Liquid crystal display panels generally include an array substrate upon which gate lines, data lines, thin film transistors, and pixel electrodes are disposed. An opposing substrate including at least one common electrode is typically disposed on the array substrate, and a liquid crystal layer is usually disposed between the array substrate and opposing substrate. The driving circuit(s) may include a gate driving part to drive the gate lines and a data driving part to drive the data lines.

As the surface area of an LCD panel increases, a resistance-capacitance (RC) time delay of gate signals transferred through the gate lines and data signals transferred through the data lines becomes more of a factor affecting display quality. For example, the RC time delay of the gate signals may occur in an area relatively far away from the gate driving part configured to output the gate signal. Because the gate signals are typically used to control a charging period of pixels when data signals are being charged to the pixels, a charging ratio may be decreased by the RC time delay of the gate signals. This RC time delay may cause, at least in part, a lowering of display quality in terms of, for example, a lowering of luminance, color mixing, ghosting, etc.

The above information disclosed in this Background section is only for enhancement of understanding of the background of the invention, and, therefore, it may contain information that does not form the prior art that is already known in this country to a person of ordinary skill in the art.

SUMMARY

Exemplary embodiments provide a display panel configured to compensate for a delay of a gate signal.

Exemplary embodiments provide a display apparatus including the display panel.

Additional aspects will be set forth in the detailed description which follows and, in part, will be apparent from the disclosure, or may be learned by practice of the invention.

According to exemplary embodiments, a display apparatus includes a display panel, a gate driving part, and a data driving part. The display panel includes: a switching element disposed in association with a pixel, a main gate line connected to the switching element, and a sub gate line spaced apart from the main gate line and connected to the main gate line via a first connecting part. The gate driving part is configured to: provide the main gate line with a main gate signal, and provide the sub gate line with a sub gate signal. The sub gate signal includes a transmission difference from the main gate signal. The data driving part is configured to provide a data line with a data signal.

According exemplary embodiments, a display panel includes: a data line, a switching element connected to the data line; a main gate line crossing the data line, the main gate line being connected to the switching element; a sub gate line spaced apart from the main gate line, the sub gate line being connected to the main gate line via a first connecting line. The first connecting line being disposed between respective end portions of the main gate line.

According to exemplary embodiments, a main gate line and a sub gate line are utilized to control a switching element of a pixel. A main gate signal is applied to the main gate line and a sub gate signal is applied to the sub gate line. In this manner, at least one of a rising period and a falling period of the sub gate signal occurs respectively prior to those of the main gate signal. As such, an RC time delay of an effective gate signal substantially applied to a central area of the pixel may be compensated. To this end, display quality may be increased or at least not diminished as much.

The foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description, serve to explain principles of the invention.

DETAILED DESCRIPTION OF THE ILLUSTRATED EMBODIMENTS

Figure 1:
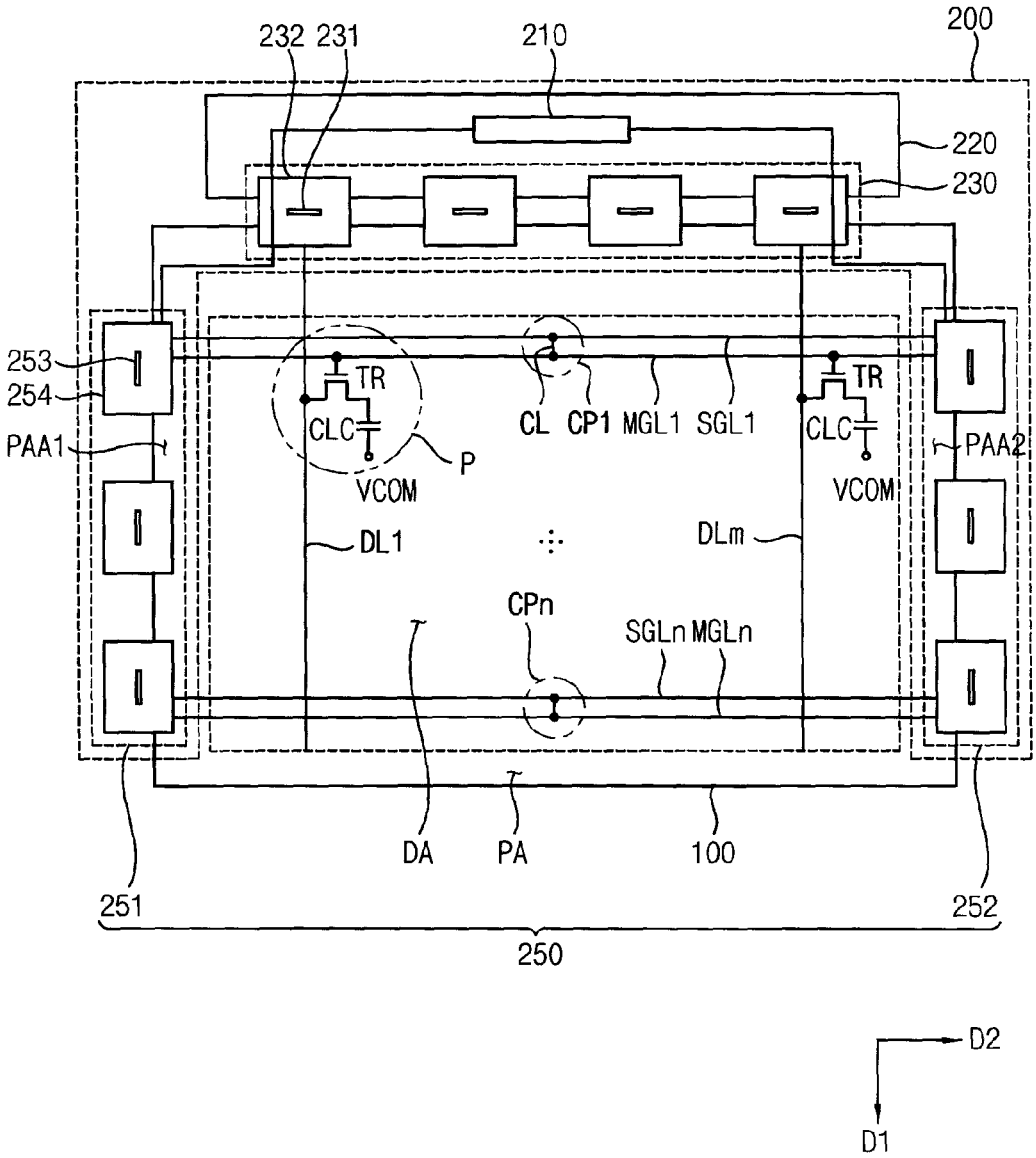
FIG. 1 is a block diagram of a display apparatus, according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
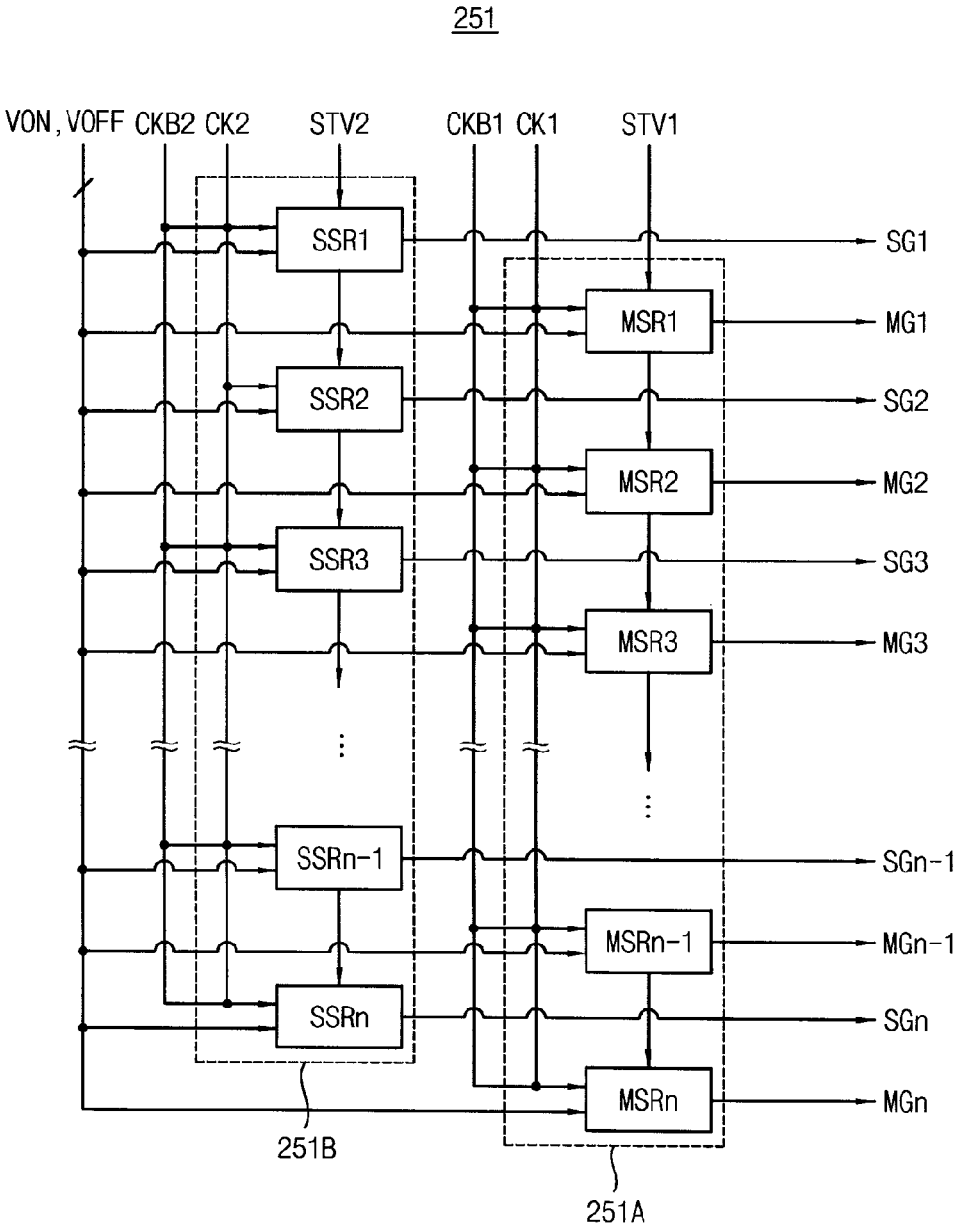
FIG. 2 is a block diagram of a gate driving part of the display apparatus of FIG. 1, according to exemplary embodiments.

FIG. 1 is a block diagram of a display apparatus, according to exemplary embodiments. FIG. 2 is a block diagram of a gate driving part of the display apparatus of FIG. 1.

Referring to FIGS. 1 and 2, the display apparatus may include a display panel 100 and a display driving part 200. The display panel 100 includes a display area DA and a non-display (or peripheral area) PA that, in exemplary embodiments, surrounds (or otherwise bounds) the display area DA. A plurality of data lines DL1, . . . , DLm, a plurality of main gate lines MGL1, . . . , MGLn, a plurality of sub gate lines SGL1, . . . , SGLn, a plurality of connecting parts CP1, . . . , CPn, and a plurality of pixels P are disposed in the display area DA. The display driving part 200 may be disposed in the peripheral area PA.

The data lines DL1, . . . , DLm longitudinally extend in (or substantially in) a first direction D1, and are arranged (e.g., spaced apart from one another) in a second direction D2. It is noted that the second direction D2 crosses the first direction D1. The second direction D2 may be orthogonal to the first direction D1.

The main gate lines MGL1, . . . , MGLn longitudinally extend in (or substantially in) the second direction D2, and are arranged in the first direction D1. The main gate lines MGL1, . . . , MGLn are configured to transfer the main gate signals MG1, . . . , MGn.

The sub gate lines SGL1, . . . , SGLn longitudinally extend in (or substantially in) the second direction D2, and are arranged in the first direction D1. Each of the sub gate lines SGL1, . . . , SGLn is respectively disposed adjacent to a corresponding one of the main gate lines MGL1, . . . , MGLn. The sub gate lines SGL1, . . . , SGLn are configured to transfer the sub gate signals SG1, . . . , SGn, and, thereby, are configured to compensate for RC time delays of the main gate signals MG1, . . . , MGn.

The connecting parts CP1, . . . , CPn respectively connect corresponding ones of the main gate lines MGL1, . . . , MGLn and the sub gate lines SGL1, . . . , SGLn. Each of the connecting parts CP1, . . . , CPn may include a connecting line CL extended in at least one direction that crosses a corresponding main gate line (e.g., main gate line MGL1) and sub gate line (e.g., sub gate line SGL1).

According to exemplary embodiments, the connecting line CL may be formed using the same metal layer and/or material as the main gate lines MGL1, . . . , MGLn and sub gate lines SGL1, . . . , SGLn. It is also contemplated that the connecting lines CL may be formed from the same conductive material as a pixel electrode (not shown) defining a liquid crystal capacitor CLC. When the connecting lines CL are formed using the same conductive material as the pixel electrode, the main gate lines MGL1, . . . , MGLn and the sub gate lines SGL1, . . . , SGLn may be connected via a contact hole (not illustrated).

For example, a first connecting part CP1 connects a first main gate line MGL1 and a first sub gate line SGL1, which may be disposed in parallel. As shown in FIG. 1, the first connecting part CP1 may be disposed in a central area of the display panel 100 in a horizontal direction, e.g., disposed in a central area disposed between respective longitudinal ends of the first main gate line MGL1 and the first sub gate line SGL1. Alternatively, the first connecting part CP1 may be disposed in a plurality of areas disposed between the respective ends of the main gate lines MGL1, . . . , MGLn and the sub gate lines SGL1, . . . , SGLn.

The pixel parts P are arranged in the display area DA, such as arranged in a matrix type formation, and, thereby, are configured to facilitate the display of an image. Each of the pixel parts P may include a switching element TR and a liquid crystal capacitor CLC. The switching element TR may include a gate electrode connected to a corresponding main gate line (e.g., the first main gate line MGL1), a source electrode connected to a corresponding data line (e.g., the first data line DL1), and a drain electrode connected to a respective liquid crystal capacitor CLC. As seen in FIG. 1, the first sub gate line SGL1 is not directly connected to the switching element TR, and, as such, is connected to the switching element TR through the first connecting part CP1.

The display driving part 200 may include a control circuit part 210, a data driving part 230 and a gate driving part 250.

According to exemplary embodiments, the control circuit part 210 is configured to control operations of the data driving part 230 and the gate driving part 250. For example, the control circuit part 210 is configured to provide the data driving part 230 with a data signal and a data control signal. The data signal may include a color data signal and may be a signal corrected using one or more compensation algorithms to improve a response time of liquid is crystal and to compensate for a white. The data control signal may include a horizontal synchronization signal, a vertical synchronization signal, a load signal, etc.

In exemplary embodiments, the control circuit part 210 is configured to provide the gate driving part 250 with a first gate control signal, a second gate control signal, a gate-on signal, a gate-off signal, etc. The first gate control signal may be a control signal to generate the main gate signals applied to the main gate lines MGL1, . . . , MGLn. The first gate control signal may include a first vertical start signal, a first clock signal, a first inversion clock signal, etc. The second gate control signal may be a control signal to generate the sub gate signals applied to the sub gate lines SGL1, . . . , SGLn. The second gate control signal may include a second vertical start signal, a second clock signal, a second inversion clock signal, etc. The second vertical start signal may be different from the first vertical start signal, the second clock signal may be different from the first clock signal, and the second inversion clock signal may be different from the first inversion clock signal.

The data driving part 230 may include a plurality of data flexible circuit boards 232, and each of the data flexible circuit boards 232 may include a data driving chip 231 disposed thereon. The data flexible circuit board 232 electrically connects the printed circuit board (PCB) 220 and the display panel 100. The gate control signal, the gate-on signal, and the gate-off signal output from the control circuit part 210 may be transferred to the gate driving part 250 through one or more data flexible circuit boards 232, such as one or more data flexible circuit boards 232 disposed adjacent to the gate driving part 250 among the plurality of data flexible circuit boards 232.

The gate driving part 250 may include a first gate circuit part 251 and a second gate circuit part 252. The first and second gate circuit parts 251 and 252 include a plurality of is gate flexible circuit boards 254 upon which corresponding gate driving chips 253 are disposed. The first gate circuit part 251 is disposed in a first pad area PAA1 of the peripheral area PA and connects with first end portions of the main and sub gate lines MGL1, . . . , MGLn and SGL1, . . . , SGLn. The second gate circuit part 252 is disposed in a second pad area PAA2 of the peripheral area PA and connects with second end portions of the main and sub gate lines MGL1, . . . , MGLn and SGL1, . . . , SGLn. The first and second gate circuit parts 251 and 252 are synchronized with each other so that the same gate signal is applied to the same gate line by each of the first and second gate circuit parts 251 and 252. Although not shown in the figures, the gate driving part 250 may be disposed in only one of the first and second pad areas PAA1 and PAA2 corresponding to first or second end portions of the main and sub gate lines MGL1, . . . , MGLn and SGL1, . . . , SGLn.

In exemplary embodiments, the control circuit part 210, the data driving part 230, the gate driving part 250 may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to exemplary embodiments, the processes described herein may be implemented via software, hardware (e.g., general processor, Digital Signal Processing (DSP) chip, an Application Specific Integrated Circuit (ASIC), Field Programmable Gate Arrays (FPGAs), etc.), firmware, or a combination thereof. In this manner, the display apparatus may include or otherwise be associated with one or more memories (not shown) including code (e.g., instructions) configured to cause the display device to perform one or more of the features/functions/processes described herein.

The memories may be any medium that participates in providing code/instructions to the one or more software, hardware, and/or firmware for execution. Such memories may take many forms, including but not limited to non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

According to exemplary embodiments, the configurations of the first and second gate circuit parts 251 and 252 are substantially the same. Therefore, to avoid obscuring exemplary embodiments described herein, the configuration of first gate circuit part 251 will be described in more detail in association with FIG. 2.

As shown in FIG. 2, the first gate circuit part 251 includes a main gate circuit 251A and a sub gate circuit 251B. Again, as previously mentioned, the configuration of the second gate circuit 252 is substantially the same as the configuration of first gate circuit part 215, and, therefore, the following description applies equally to the second gate circuit part 252.

The main gate circuit 251A may include a plurality of main shift registers MSR1, . . . , MSRn. The main gate circuit 251A is configured to receive the first vertical start signal STV1, the first clock signal CK1, the first inversion clock signal CKB1, the gate-on signal VON and the gate-off signal VOFF from the control circuit part 210. The main gate circuit 251A is configured to generate (e.g., sequentially generate) the main gate signals MG1, . . . , MGn using the first clock signal CK1, the first inversion clock signal CKB1, the gate-on signal VON, and the gate-off signal VOFF in response to receiving the first vertical start signal STV1. Each of the main gate signals MG1, . . . , MGn may have a pulse, such as a square wave pulse, and the pulse width may be greater than a horizontal period (1H). It is contemplated, however, that any other suitably shaped pulse may be utilized.

The sub gate circuit 251B may include a plurality of sub shift registers SSR1, . . . , SSRn. The sub gate circuit 251B may be configured to receive the second vertical start signal STV2, the second clock signal CK2, the second inversion clock signal CKB2, the gate-on signal VON, and the gate-off signal VOFF from the control circuit part 210. The sub gate circuit 251B is configured to generate (e.g., sequentially generate) the sub gate signals SG1, . . . , SGn using the second clock signal CK2, the second inversion clock signal CKB2, the gate-on signal VON, and the gate-off signal VOFF in response to receiving the second vertical start signal STV2. Each of the sub gate signals SG1, . . . , SGn may have a pulse, such as a square wave pulse, and the pulse width may be greater than the horizontal period (1H). As with the shape of the main gate signals MG1, . . . , MGn, it is contemplated that any other suitably shaped pulse may be utilized in association with the sub gate signals SG1, . . . , SGn.

According to exemplary embodiments, a pulse width of the sub gate signals SG1, . . . , SGn may be equal to or different from the pulse widths of the main gate signals MG1, . . . , MGn. In addition, at least one of a rising period and a falling period of the sub gate signals SG1, . . . , SGn may have a delay difference that is delayed from the corresponding rising period and falling period of the main gate signals MG1, . . . , MGn. For example, the square waves in the is sub gate signals SG1, . . . , SGn have a rising period equal to or different from the rising period of the square wave in the main gate signals MG1, . . . , MGn. As another example, the square wave in the sub gate signals SG1, . . . , SGn have a falling period being equal to or different from the falling period of the square wave in the main gate signals MG1, . . . , MGn.

Figure 3:
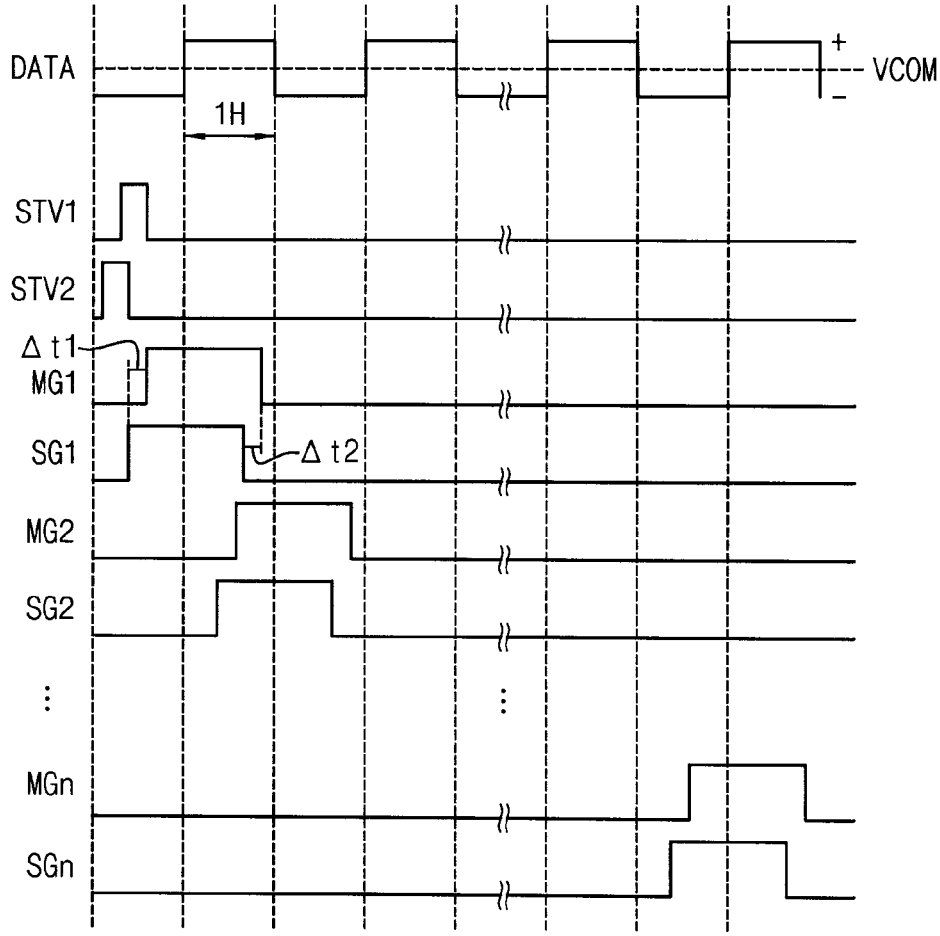
FIG. 3 is a waveform diagram of output signals of a data driving part and the gate driving part of the display apparatus of FIG. 1, according to exemplary embodiments.

FIG. 3 is a waveform diagram of output signals of the data driving part 230 and the gate driving part 250 of the display apparatus of FIG. 1, according to exemplary embodiments.

Referring to FIGS. 1, 2 and 3, the data driving part 230 is configured to output a data signal DATA to the data lines DL1, . . . , DLm with a horizontal period 1H. As shown in FIG. 3, according to an inversion mode, the data signal may be inversed in the horizontal period 1H.

According to exemplary embodiments, a pulse of the second vertical start signal STV2 occurs prior to a corresponding pulse of the first vertical start signal STV1. As such, the sub gate circuit 251B is configured to sequentially provide the first to n-th sub gate lines SGL1, . . . , SGLn with first to n-th sub gate signals SG1, . . . , SGn in response to receiving the second vertical start signal STV2 from the control circuit part 210. Each of the sub gate signals SG1, . . . , SGn may have a pulse, such as a square wave pulse, and the pulse width may be greater than the width of the horizontal period 1H.

The main gate circuit 251A sequentially provides the first to n-th main gate lines MGL1, . . . , MGLn with first to n-th main gate signals MG1, . . . , MGn in response to receiving the first vertical start signal STV1 from the control circuit part 210. Each of the main gate signals MG1, . . . , MGn may have a pulse, such as a square wave pulse, and the pulse width of the main gate signals MG1, . . . , MGn may be larger than the width of the horizontal period 1H. The pulse width of the main gate signals MG1, . . . , MGn may be substantially the same as the pulse width of the sub gate signals SG1, . . . , SGn.

For example, as shown in FIG. 3, the square wave of the sub gate signals SG1, . . . , SGn has a rising period and a falling period that occurs prior to the rising periods and falling periods of the square wave in the main gate signals MG1, . . . , MGn. Referring to the first main gate signal MG1 and the first sub gate signal SG1, the rising period of the first sub gate signal SG1 occurs prior to the rising period of the first main gate signal MG1 by a first delay difference Δt1. The switching element TR is turned on by the first sub gate signal SG1 prior to the first main gate signal MG1 so that a rising delay of an effective gate signal substantially applied to the switching element TR may be decreased. In addition, the falling period of the first sub gate signal SG1 occurs prior to the falling period of the first main gate signal MG1 by a second delay difference Δt2. The switching element TR is turned off by the first sub gate signal SG1 prior to the first main gate signal MG1 so that a falling delay of the effective gate signal substantially applied to the switching element TR may be decreased. The first and second delay differences Δt1 and Δt2 are equal to or different from each other and are smaller than the horizontal period 1H.

As described above, the rising and falling delays of the effective gate signal substantially applied to the switching element TR may be decreased by the sub gate signals SG1, . . . , SGn, and, as such, an RC time delay may be decreased in a central area of the display panel 100, which is typically vulnerable to display quality degradations caused, at least in part, by the RC time delay.

Figure 4:
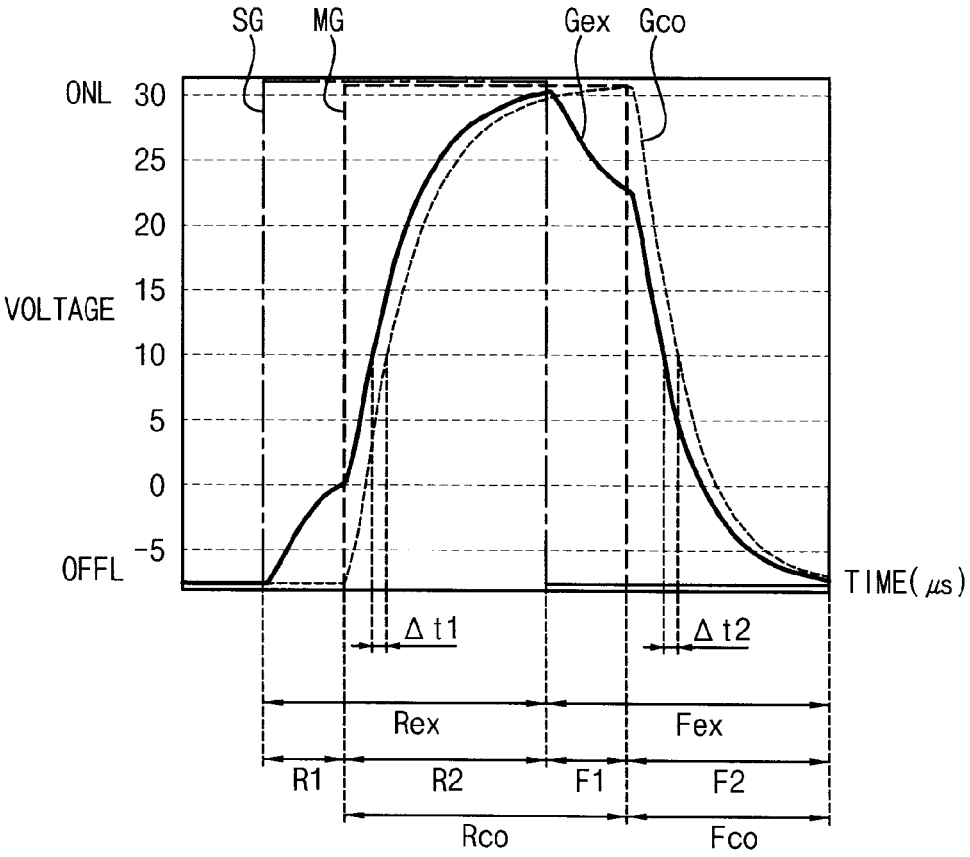
FIG. 4 is a waveform diagram of a method of compensating an RC time delay using main gate signals and sub gate signals as shown in FIG. 3, according to exemplary embodiments.

FIG. 4 is a waveform diagram of a method of compensating an RC time delay using main gate signals and sub gate signals as shown in FIG. 3, according to exemplary embodiments.

Referring to FIGS. 1 and 4, the RC time delay of the effective gate signal substantially applied to the pixel P in the central area of the display panel 100 will be explained.

According to exemplary embodiments, as described in reference to FIGS. 1 to 3, the pixel part in the central area of the display panel 100 receives a gate signal Gex through a corresponding main gate line MGL and a respective sub gate line SGL that are connected to each other by at least one connecting part CP. However, in conventional display devices, the pixel part in the central area of the display panel 100 would receive a gate signal Gco through a single gate line, that is, only a main gate line.

According to exemplary embodiments, referring to the RC time delay of the gate signal Gex, the main gate signal MG and the sub gate signal SG without the RC time delay are output from the gate driving part 250, and then the main gate signal MG and the sub gate signal SG are delayed, such as the gate signal Gex including a rising delay period Rex and a falling delay period Fex delayed by a resistance and capacitance of the display panel 100 associated with the pixel part. The gate signal Gex includes a first rising delay period R1 delayed from the rising period during which the sub gate signal SG rises from an OFF-level OFFL to an ON-level ONL, a second rising delay period R2 delayed from the rising period during which the main gate signal MG rises from the OFF-level OFFL to the ON-level ONL, a first falling delay period F1 delayed from the falling period during which the sub gate signal SG falls from the ON-level ONL to the OFF-level OFFL and a second falling delay period F2 delayed from the falling period during which the main gate signal MG falls from the ON-level ONL to the OFF-level OFFL. In the first falling delay period F1, the gate signal Gex falls to a determined level by the falling period of the sub gate signal SG; however, the determined level is more than a threshold level so that a charging time during which the data signal DATA is charged to the pixel part P may be sufficiently obtained.

According to exemplary embodiments, the rising delay period Rex of the gate signal Gex includes first and second rising delay periods R1 and R2 in synchronization with the rising period of the main gate signal MG and the sub gate signal SG. The falling delay period Fex of the gate signal Gex includes first and second falling delay periods F1 and F2 in synchronization with the falling period of the main gate signal MG and the sub gate signal SG. However, in a conventional display device, the gate signal Gco includes a rising delay period Rco delayed from the rising period of the main gate signal MG and a falling delay period Fco delayed from the falling period of the main gate signal MG.

The rising delay period Rex of the gate signal Gex according to exemplary embodiments occurs prior to the rising delay period Rco of the gate signal Gco in a conventional display device by the first period Δt1. In addition, the falling delay period Fex of the gate signal Gex according to exemplary embodiments, occurs prior to the falling delay period Fco of the gate signal Gco in a conventional display device by a second period Δt2.

As shown in FIG. 4, the RC time delay of the gate signal Gex according to exemplary embodiments may be improved greater than that of the gate signal Gco associated with a conventional display device. To this end, the gate signal Gex rises more quickly to the ON-level ONL based on the sub gate signal SG and more quickly falls to the OFF-level OFFL based on the sub gate signal SG, such that the rising delay period and the falling delay period of the gate signal Gex are all controlled to be quicker than a conventional display device. As such, the RC time delay may be compensated and display quality may be increased.

Figure 5:
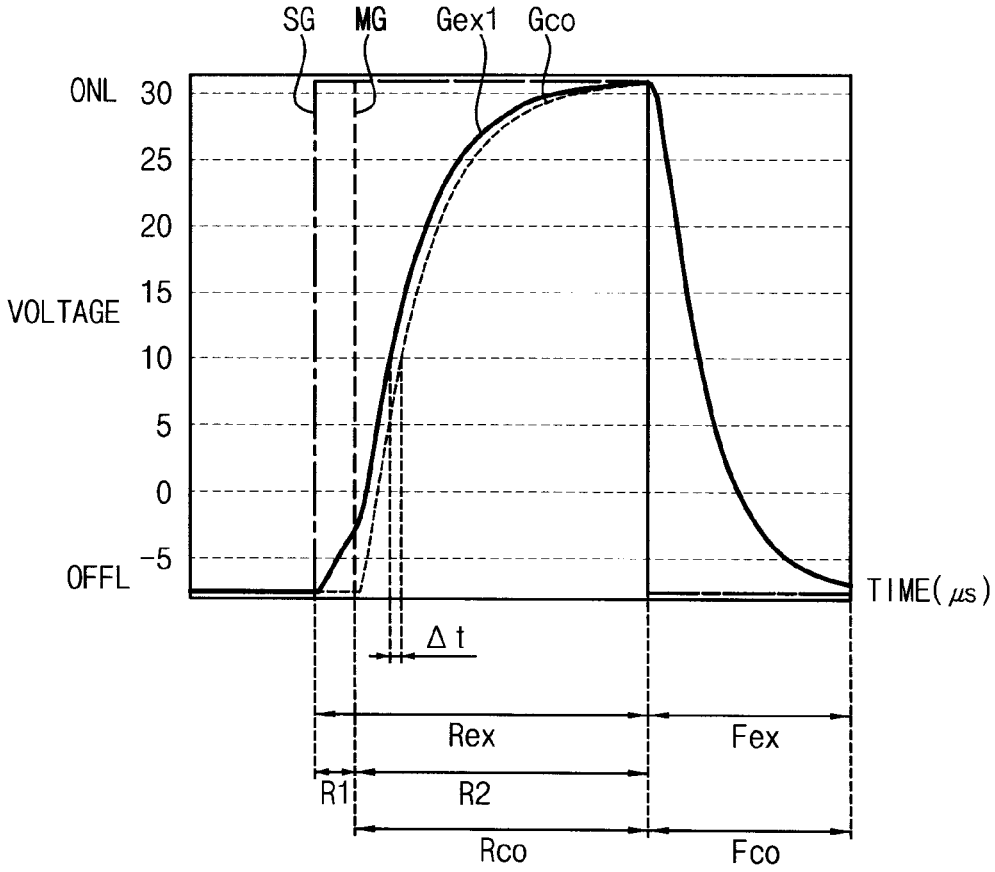
FIG. 5 is a waveform diagram of a method of compensating an RC time delay using main gate signals and sub gate signals, according to exemplary embodiments.

FIG. 5 is a waveform diagram of a method of compensating an RC time delay using main gate signals and sub gate signals, according to exemplary embodiments.

Referring to FIG. 5, according to exemplary embodiments, the rising period of the sub gate signal SG occurs prior to the rising period of the main gate signal MG, and the falling period of the sub gate signal SG is equal to (or substantially equal to) the falling period of the main gate signal MG.

According to exemplary embodiments, the pixel part in the central area of the display panel 100 receives a gate signal Gex1 through the main gate line MGL and the sub gate line SGL, which are connected to each other by at least one connecting part CP, as shown in FIGS. 1 and 5. The pixel part in the central area receives the delayed gate signal Gex1. In a conventional display device, however, the pixel part in the central area of the display panel 100 receives a gate signal Gco through a single gate line, that is, only a main gate line.

According to exemplary embodiments, referring to the RC time delay of the gate signal Gex1, the main gate signal MG and the sub gate signal SG without the RC time delay output from the gate driving part 250, and then the main gate signal MG and the sub gate signal SG are delayed as the gate signal Gex1. The gate signal Gex1 includes a rising delay period Rex and a falling delay period Fex delayed by a resistance and capacitance of the display panel 100 associated with the pixel part. The gate signal Gex1 includes a first rising delay period R1 delayed from the rising period during which the sub gate signal SG rises from an OFF-level OFFL to an ON-level ONL, and a second rising delay period R2 delayed from the rising period during which the main gate signal MG rises from the OFF-level OFFL to the ON-level ONL. In addition, the gate signal Gex1 includes a falling delay period Fex delayed from the falling period during which the main gate signal MG and the sub gate signal SG fall from the ON-level ONL to the OFF-level OFFL. However, in a conventional display device, the gate signal Gco includes a is rising delay period Rco delayed from the rising period of the main gate signal MG and a falling delay period Fco delayed from the falling period of the main gate signal MG.

According to exemplary embodiments, the rising delay period Rex of the gate signal Gex1 occurs prior to the rising delay period Rco of the gate signal Gco in a conventional display device by a period Δt. The falling delay period Fex of the gate signal Gex1, according to exemplary embodiments, is substantially the same as the falling delay period Fco of the gate signal Gco in the conventional display device. As such, according to exemplary embodiments, when the rising period of the sub gate signal SG occurs prior to the rising period of the main gate signal MG and the falling period of the sub gate signal SG is equal to (or substantially equal to) the falling period of the main gate signal MG, the gate signal Gex1 may have a rising period compensated by the RC time delay. To this end, the display quality of the display apparatus 100 may be better than the display quality of a conventional display device.

Although not illustrated, the rising period of the sub gate signal SG may be the same (or substantially the same) as that of the main gate signal MG, and the falling period of the sub gate signal SG may occur prior to that of the main gate signal MG. In this manner, when the rising period of the sub gate signal SG is the same (or substantially the same) as the rising period of the main gate signal MG, and the falling period of the sub gate signal SG occurs prior to the falling period of the main gate signal MG, an associated gate signal may have a falling period compensated by the RC time delay.

Figure 6:
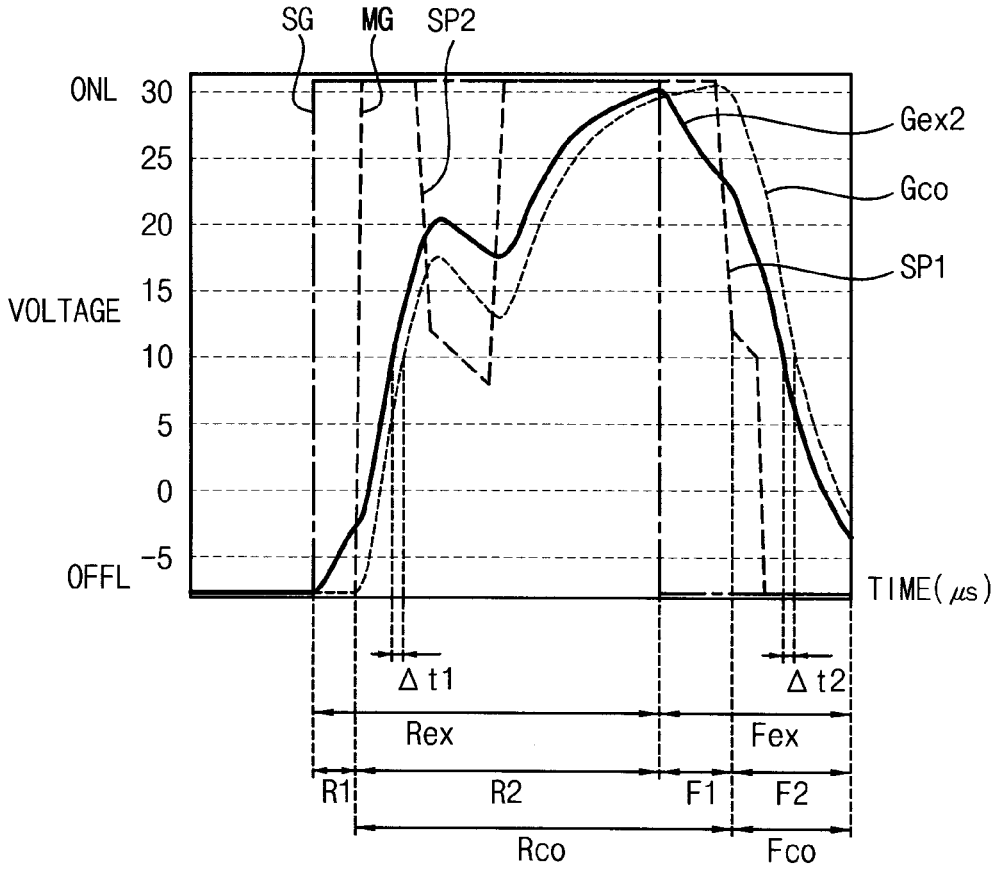
FIG. 6 is a waveform diagram of a method of compensating an RC time delay using main and sub gate signals, according to exemplary embodiments.

FIG. 6 a waveform diagram of a method of compensating an RC time delay using main gate signals and sub gate signals, according to exemplary embodiments.

Referring to FIG. 6, according to exemplary embodiments, the main gate signal MG includes a first slice part SP1 sliced in a falling edge portion so that the first slice part SP1 compensates the RC time delay of a kickback voltage (or reflection signal), which may be caused by, for example, impedance mismatching. When the main gate signal MG overlaps with a previous main gate signal MG, the main gate signal MG may further include a second slice part SP2 in synchronization with the first slice part SP1 of the previous main gate signal MG.

According to exemplary embodiments, the sub gate signal SG occurs prior to the main gate signal MG. In other words, the rising period of the sub gate signal SG occurs prior to the rising period of the main gate signal MG. The falling period of the sub gate signal SG occurs prior to the falling period of the main gate signal MG. The sub gate signal SG may be a square wave without the slice part, as shown in FIG. 6. As such, the pixel part in the central area of the display panel 100 receives a gate signal Gex2 through the main gate line MGL and the sub gate line SGL, which are connected to each other by at least one connecting part CP, as shown in FIGS. 1 and 6. However, in a conventional display device, the pixel part in the central area of the display panel 100 receives a gate signal Gco through a single gate line, that is, only a main gate line.

According to exemplary embodiments, referring to the RC time delay of the gate signal Gex2, the gate signal Gex2 includes a rising delay period Rex and a falling delay period Fex delayed by a resistance and capacitance of the display panel 100 associated with the pixel part. The gate signal Gex2 includes a first rising delay period R1 delayed from the rising period during which the sub gate signal SG rises from an OFF-level OFFL to an ON-level ONL, a second rising delay period R2 delayed from the rising period during which the main gate signal MG rises from the OFF-level OFFL to the ON-level ONL, a first falling delay period F1 delayed from the falling period during which the sub gate signal SG falls from the ON-level ONL to the OFF-level OFFL, and a second falling delay period F2 delayed from the falling period during is which the main gate signal MG falls from the ON-level ONL to the OFF-level OFFL. In a conventional display device, however, the gate signal Gco includes a rising delay period Rco delayed from the rising period of the main gate signal MG and a falling delay period Fco delayed from the falling period of the main gate signal MG.

The rising delay period Rex of the gate signal Gex2, according to exemplary embodiments, occurs prior to the rising delay period Rco of the gate signal Gco for a conventional display device by a first period Δt1. In addition, the falling delay period Fex of the gate signal Gex2, according to exemplary embodiments, occurs prior to the falling delay period Fco of the gate signal Gco for a conventional display device by a second period Δt2. As shown in FIG. 6, the RC time delay of the gate signal Gex2, according to exemplary embodiments, may be improved over the gate signal Gco for a conventional display device.

Although not illustrated, with respect to the main gate signal MG including the slice part, as shown in FIG. 6, the rising period of the sub gate signal SG may occur prior to the rising period of the main gate signal MG, and the falling period of the sub gate signal SG may be the same as the falling period of the main gate signal MG. In this manner, a corresponding gate signal may have just the rising period compensating for the RC time delay. As another example, the rising period of the sub gate signal SG may be the same as the rising period of the main gate signal MG, and the falling period of the sub gate signal SG may occur prior to the falling period of the main gate signal MG. In this manner, a corresponding gate signal may have just the falling period compensating for the RC time delay.

Figure 7A:
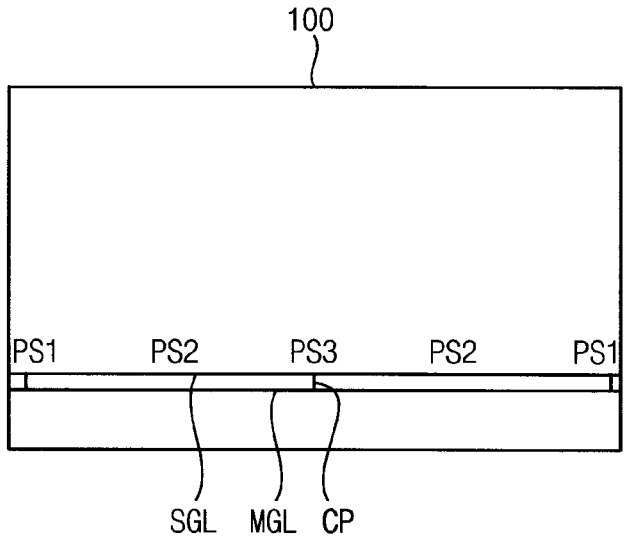
FIGS. 7A to 7D are conceptual diagrams of a method of compensating an RC time delay in each position of a display panel, according to exemplary embodiments.
Figure 7B:
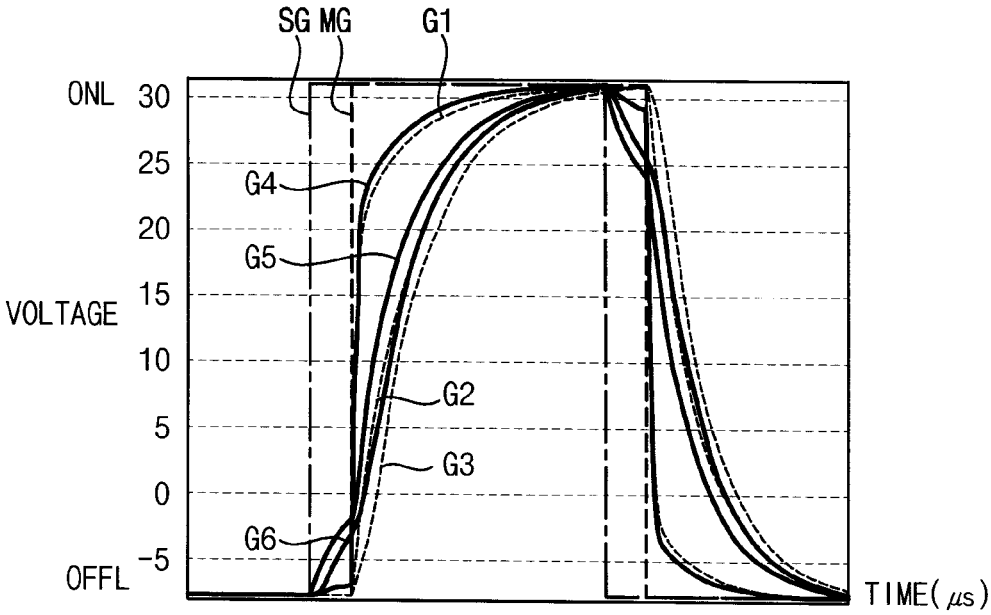

FIGS. 7A to 7B are conceptual diagrams of a method of compensating an RC time delay in each position of a display panel, according to exemplary embodiments.

With continued reference to FIG. 1, FIG. 7A shows an area of the display panel 100 including the connecting part CP, which connects the main gate line MGL and the sub gate line SGL in the second direction of the display panel 100. A first area PS1 is an area adjacent to a pad area PAA in which the gate driving part 250 is disposed. A third area PS3 is a central area of the display panel 100 in the horizontal direction. A second area PS2 is a central area between the first area PS1 and the third area PS3.

According to a comparative example of a conventional display device, when the main gate signal MG is transferred through a single gate line, that is, only a main gate line MGL, each of first, second and third gate signals G1, G2 and G3 (as shown in FIG. 7B) is a gate signal respectively measured at the first, second, and third areas PS1, PS2 and PS3 of the conventional display device.

According to exemplary embodiments, when the main gate signal MG and the sub gate signal SG are transferred through the main gate line MGL and the sub gate line SGL, which are connected to each other via at least one connecting part CP, each of the fourth, fifth, and sixth gate signals G4, G5, and G6 (as shown in FIG. 7B) is a gate signal respectively measured at the first, second, and third areas PS1, PS2, and PS3.

FIG. 7B shows the RC time delay when the connecting part CP is located in a single area, that is, the second area PS2. Referring to FIG. 7B, the RC time delay of the fourth, fifth, and sixth gate signals G4, G5, and G6 may be improved more than the RC time delay of the first, second, and third gate signals G1, G2, and G3 by about 0.2/ZS (i.e., about 17%).

Figure 7C:
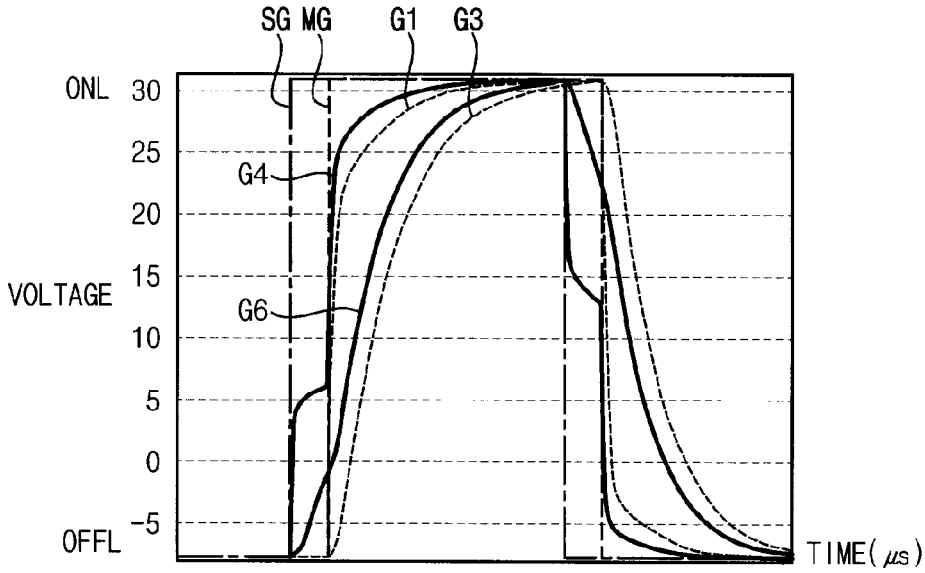

FIG. 7C shows the RC time delay when connecting parts CP are located in two areas, i.e., the first and third areas PS1 and PS3. Referring to FIG. 7C, the RC time delay of the fourth, fifth, and sixth gate signals G4, G5, and G6 may be improved more than the RC time delay of the first, second, and third gate signals G1, G2, and G3 by about 0.31/ZS (i.e., about 25%).

Figure 7D:
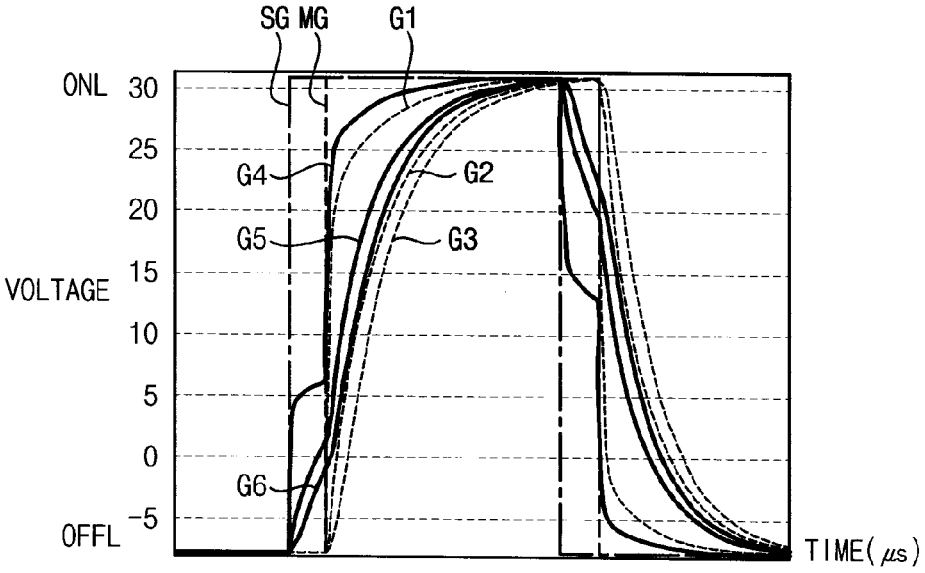

FIG. 7D shows the RC time delay when connecting parts CP are located in three areas, that is, the first, second, and third areas PS1, PS2 and PS3. Referring to FIG. 7D, the RC time delay of the fourth, fifth, and sixth gate signals G4, G5, and G6 may be improved more than the RC time delay of the first, second, and third gate signals G1, G2, and G3 by about 0.31/ZS (i.e., about 25%).

As described above, the RC time delay when the connecting parts CP are located in three areas, i.e., the first, second, and third areas PS1, PS2, and PS3, may be the same as the RC time delay when connecting parts CP are located in two areas, i.e., the first and third areas PS1 and PS3. Therefore, a compensation effect with respect to the RC time delay of the gate signal when the connecting part CP is located in at least two areas may be increased more efficiently, e.g., with less material be used for the associated display panel 100.

According to exemplary embodiments, the main gate line MGL and the sub gate line SGL are connected in parallel. The main gate signal MG is applied to the main gate line MGL and the sub gate signal SG is applied to the sub gate line SGL. At least one of the rising period and the falling period of the sub gate signal SG occurs prior to that of the main gate signal MG so that the RC time delay of the effective gate signal applied to the pixel part in the central area of the display panel 100 may be compensated.

While certain exemplary embodiments and implementations have been described herein, other embodiments and modifications will be apparent from this description. Accordingly, the invention is not limited to such embodiments, but rather to the broader scope of the presented claims and various obvious modifications and equivalent arrangements.

What is claimed is:

1. A display apparatus, comprising:

a display panel comprising:

a switching element disposed in association with a pixel, a main gate line connected to the switching element, and a sub gate line spaced apart from the main gate line and connected to the main gate line via a first connecting part;

a gate driving part configured to:

provide the main gate line with a main gate signal, and provide the sub gate line with a sub gate signal, the sub gate signal comprising a transmission difference from the main gate signal; and a data driving part configured to provide a data line with a data signal.

2. The display apparatus of claim 1, wherein the first connecting part is disposed in a central area between respective end portions of the main gate line.

3. The display apparatus of claim 2, further comprising:

a second connecting part connecting the main gate line and the sub gate line, wherein the second connecting part is disposed between the central area and an area of the display apparatus comprising the gate driving part.

4. The display apparatus of claim 3, further comprising:

a third connecting part connecting the main gate line and the sub gate line, wherein the third connecting part is disposed between the first connecting part and the second connecting part.

5. The display apparatus of claim 1, wherein the transmission difference between the main gate signal and the sub gate signal is less than one horizontal period.

6. The display apparatus of claim 5, wherein a rising period of the sub gate signal occurs prior to a rising period of the main gate signal.

7. The display apparatus of claim 6, wherein a falling period of the sub gate signal occurs prior to a falling period of the main gate signal.

8. The display apparatus of claim 6, wherein a falling period of the sub gate signal is substantially the same as a falling period of the main gate signal.

9. The display apparatus of claim 5, wherein a rising period of the sub gate signal is substantially the same as a rising period of the main gate signal.

10. The display apparatus of claim 9, wherein a falling period of the sub gate signal occurs prior to a falling period of the main gate signal.

11. The display apparatus of claim 1, wherein the gate driving part comprises:

a main gate circuit configured to generate the main gate signal based on a first gate control signal; and a sub gate circuit configured to generate the sub gate signal based on a second gate control signal, the second gate control signal being different from the first gate control signal.

12. The display apparatus of claim 1, wherein the gate driving part comprises:

a first gate circuit part connected to respective first end portions of the main gate line and the sub gate line, the first gate circuit part being configured to provide the main gate line with the main gate signal and the sub gate line with the sub gate signal; and a second circuit part connected to respective second end portions of the main gate line and the sub gate line, the second circuit part being configured to provide the main gate line with the main gate signal and the sub gate line with the sub gate signal.

13. The display apparatus of claim 12, wherein each of the first and second gate circuit parts comprises:

a main gate circuit configured to generate the main gate signal based on a first gate control signal; and a sub gate circuit configured to generate the sub gate signal based on a second gate control signal, the second gate control signal being different from the first gate control signal.

14. The display apparatus of claim 1, wherein each of the main gate signal and the sub gate signal comprise a pulse width greater than one horizontal period.

15. The display apparatus of claim 14, wherein the pulse width is sliced in at least one of a rising edge portion and a falling edge portion.

16. A display panel, comprising:

a data line;

a switching element connected to the data line;

a main gate line crossing the data line, the main gate line being connected to the switching element; and a sub gate line spaced apart from the main gate line, the sub gate line being connected to the main gate line via a first connecting line, wherein the first connecting line is disposed between respective end portions of the main gate line.

17. The display panel of claim 16, wherein the first connecting line longitudinally extends in a direction crossing the main gate line and the sub gate line.

18. The display panel of claim 17, wherein the first connecting line is disposed in a central area between the respective end portions of the main gate line.

19. The display panel of claim 18, further comprising:

a second connecting part connecting the main gate line and the sub gate line, wherein the second connecting part is disposed between the central area and one of the respective end portions of the main gate line.

20. The display panel of claim 19, further comprising:

a third connecting part connecting the main gate line and the sub gate line, wherein the third connecting part is disposed between the first connecting part and the second connecting part.

* * * * *